US009359054B2

(12) United States Patent
Watts et al.

(10) Patent No.: US 9,359,054 B2
(45) Date of Patent: Jun. 7, 2016

(54) CONTROL MECHANISM

(71) Applicants: Thomas W Watts, Panama City, FL (US); Miller W Owen, III, Panama City, FL (US); Shane Huseby, Panama City, FL (US); Steven Edward Caskey, Panama City, FL (US)

(72) Inventors: Thomas W Watts, Panama City, FL (US); Miller W Owen, III, Panama City, FL (US); Shane Huseby, Panama City, FL (US); Steven Edward Caskey, Panama City, FL (US)

( * ) Notice: Subject to any disclaimer, the term of this patent is extended or adjusted under 35 U.S.C. 154(b) by 328 days.

(21) Appl. No.: 13/717,974

(22) Filed: Dec. 18, 2012

(65) Prior Publication Data

US 2014/0165896 A1 Jun. 19, 2014

Related U.S. Application Data

(63) Continuation-in-part of application No. 12/927,950, filed on Nov. 30, 2010, now abandoned.

(51) Int. Cl.

| | |
|---|---|
| ***B63H 11/117*** | (2006.01) |
| ***B63H 11/107*** | (2006.01) |
| *B63H 25/46* | (2006.01) |

(52) U.S. Cl.
CPC ..... *B63H 11/107* (2013.01); *B63H 25/46* (2013.01)

(58) Field of Classification Search
CPC ..... B63H 11/117; B63H 11/113
USPC ..... 114/150; 440/40–43
See application file for complete search history.

(56) References Cited

U.S. PATENT DOCUMENTS

| | | | | |
|---|---|---|---|---|
| 5,421,279 | A * | 6/1995 | Louks et al. | 114/145 A |
| 6,336,834 | B1 * | 1/2002 | Nedderman et al. | 440/43 |
| 2012/0285355 | A1 * | 11/2012 | Walkowiak | 114/163 |

* cited by examiner

*Primary Examiner* — Edwin Swinehart
(74) *Attorney, Agent, or Firm* — J. Wiley Horton; Adrienne C. Love

(57) ABSTRACT

An auxiliary appendage attachable to the steerable nozzle of an existing water craft. A first and second rudder blade attach to steerable nozzle. The first rudder blade includes a torsion spring providing a downward torsion force. A detent attached to steerable nozzle prevents rudder blades from hyper-extending in the direction of the downward torsion force. Rudder blades are connected by a deflection bar. Deflection bar is angled towards rudder blades. Rudder blades pivot between a downward position to an upward position based on the forces created thereon from both the torsion spring and the movement of the water over the appendage.

3 Claims, 8 Drawing Sheets

CONTROL MECHANISM

CROSS-REFERENCES TO RELATED APPLICATIONS

This application is a continuation-in-part of U.S. application Ser. No. 12/927,950, which lists the same inventor and remains pending.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of control and steering mechanisms for watercraft vessels. More specifically, the invention comprises an auxiliary appendage for off-plane steering, maneuverability and reactionary turning radius for watercraft vessels which are propelled by water-jet style systems.

2. Description of the Related Art

Currently, the low speed directional change capability of a water-jet driven craft is directly proportional to the force and volumetric flow rate provided by the thrust of the water jet propulsion system. At slow or idle speed, this force is minimal, resulting in sluggish steering response, which reduces control of the craft when idling, docking or in the vicinity of other watercraft. The reduction or minimal ability to control the vessel reduces the capability of the operator to safely maneuver the craft, and has been responsible for numerous accidents, personal injuries, and monetary damages. Because most of the vessels are not equipped with any type of braking system, it is imperative that the operator be in control of the vessel at all times and speeds.

In a 1998 report, the National Transportation Safety Board criticized the basic design of all personal watercraft (PWC), reporting that PWCs have no braking mechanism and that they coast to a stop, and while coasting, there is no turning ability. Many experts concur that what makes PWCs so dangerous is the fact that it will not steer when the operator lets off the throttle. Being rudderless, when the throttle is off, a speeding jet ski or boat cannot stop, nor turn, leaving the operator with no control.

A growing number of safety experts believe that, converse to industry claims, the vehicles themselves, not simply the riders, cause copious injuries and fatalities throughout the U.S. These experts believe those PWCs are a danger, not only to their own riders, but to swimmers, boaters, indeed, anyone who may be in the crafts vicinity. There is much evidence to support that hypothesis.

Water jet propulsion vessels have become popular for recreational water crafts. A prior art water craft 30 is illustrated in FIG. 1. These crafts are typically propelled by two or four stroke gasoline engines in connection with an impeller housed in a tubular chamber, the forward end of which draws in the water and the rearward end which expels it to provide thrust in order to propel the craft or vessel. In most instances, a tubular nozzle (steerable nozzle 32) is attached to the discharge end which pivots from side to side in sync with the steering control 34 to provide steering capability. In fewer cases, a deflector plate is provided at the exhaust end to deflect the jet flow to one side or the other of the-craft. While a variety of systems have been used in connection with water-jet powered craft, no one system is entirely effective. As an example, there are existing devices which include an integrated rudder system but do not have an effective and efficient means of pivoting the rudders upward out of the water.

Thus, what is needed is a device which can increase control over the vessel at lower speeds without sacrificing control over the vessel at higher speeds. The named Invention addresses many aspects of these concerns, creating a safer, more controlled craft.

BRIEF SUMMARY OF THE INVENTION

The present invention is an auxiliary appendage provided to improve off-plane steering, craft maneuverability and reactionary turning radius. Auxiliary appendage attaches to the steerable nozzle of an existing water craft. A first and second rudder blade attach to steerable nozzle. The first rudder blade includes a torsion spring. Torsion spring provides an adjustable downward torsion force on rudder blades. A detent attached to steerable nozzle prevents rudder blades from hyper-extending in the direction of the downward torsion force. Rudder blades are connected by a deflection bar. Deflection bar is slightly angled towards rudder blades. In operation, at low speeds, the downward torsion force created on rudder blades maintains rudder blades in a position which allows rudder blades to directionally control the craft by pivoting with the steerable nozzle of the water craft. As the water craft moves through the water at increasing speeds, the force created by the moving water on the deflection bar increases and pulls the rudder blades in an upward direction. As the rudder blades pivot about a pivot point, the deflection bar enters jet stream. Jet stream forces deflection bar upward quickly through jet stream. Deflection bar pulls rudder blades into an upward position in which rudder blades no longer affect the directional control of the craft. This action is desirable as it eliminates high stress and sheer loads on the steerable nozzle and jet pump that rigid mounted rudders would induce.

The invention provides all of these features, advantages, and objects along with others that will become apparent with reference to the following description and accompanying drawings.

REFERENCE NUMERALS IN THE DRAWINGS

| | | | |
|---|---|---|---|
| 10 | auxiliary appendage | 12 | first rudder blade |
| 14 | second rudder blade | 16 | spring tensioner |
| 18 | torsion spring | 20 | deflection bar |
| 22 | detent | 24 | bolt |
| 26 | stabilization bar | 28 | bolt |
| 30 | water craft | 32 | steerable nozzle |
| 34 | steering control | 36 | reverse gate |
| 38 | jet stream | 40 | exit point |
| 42 | thrust reversal channel | 44 | exit point |
| 46 | pivot point | 48 | bolt |
| 50 | threaded bolt | 52 | washer |
| 54 | standoff | | |

DETAILED DESCRIPTION OF THE INVENTION

Figure 1:
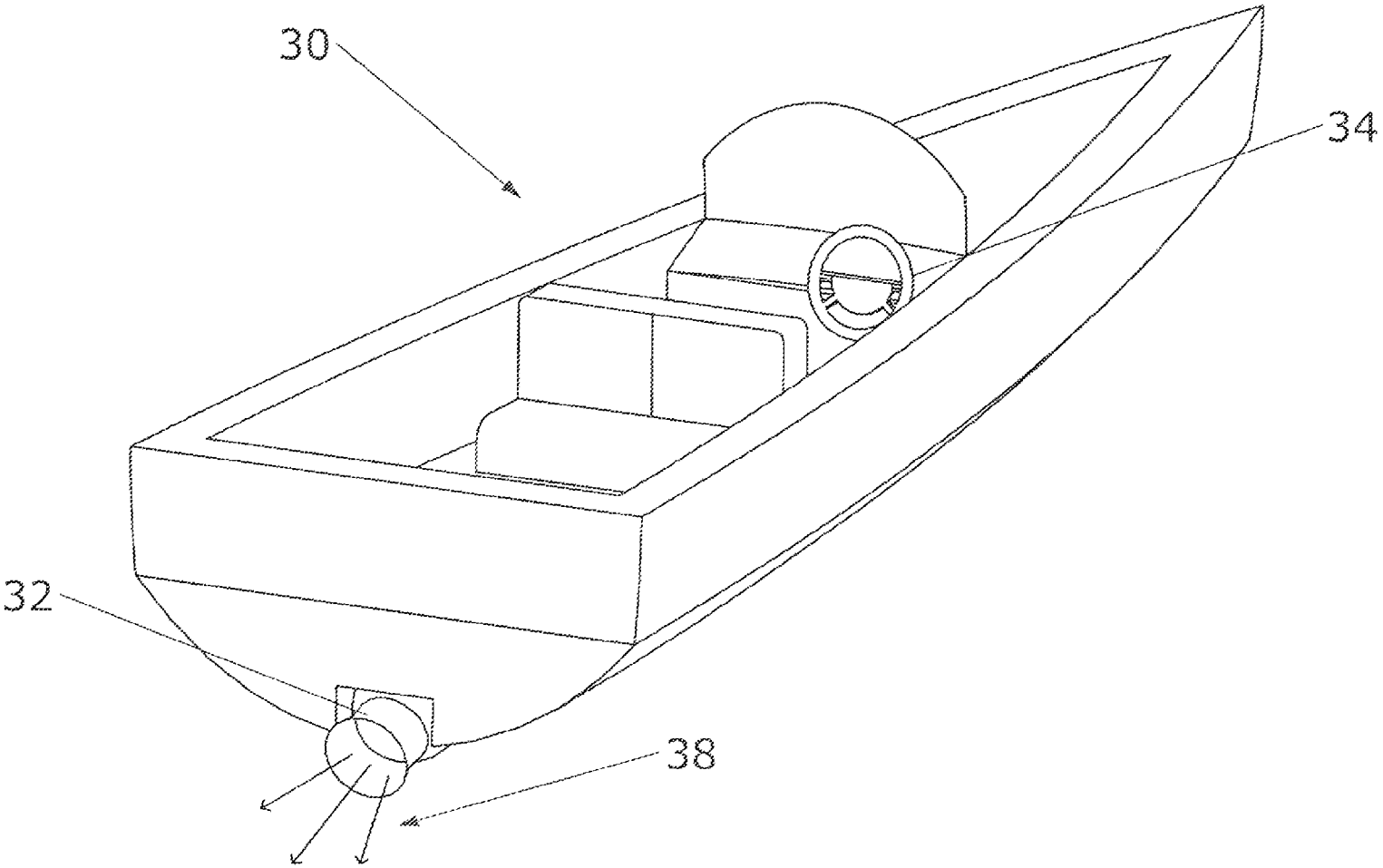
FIG. 1 (PRIOR ART)
FIG. 1 is a perspective view, showing a prior art water craft.
Figure 2:
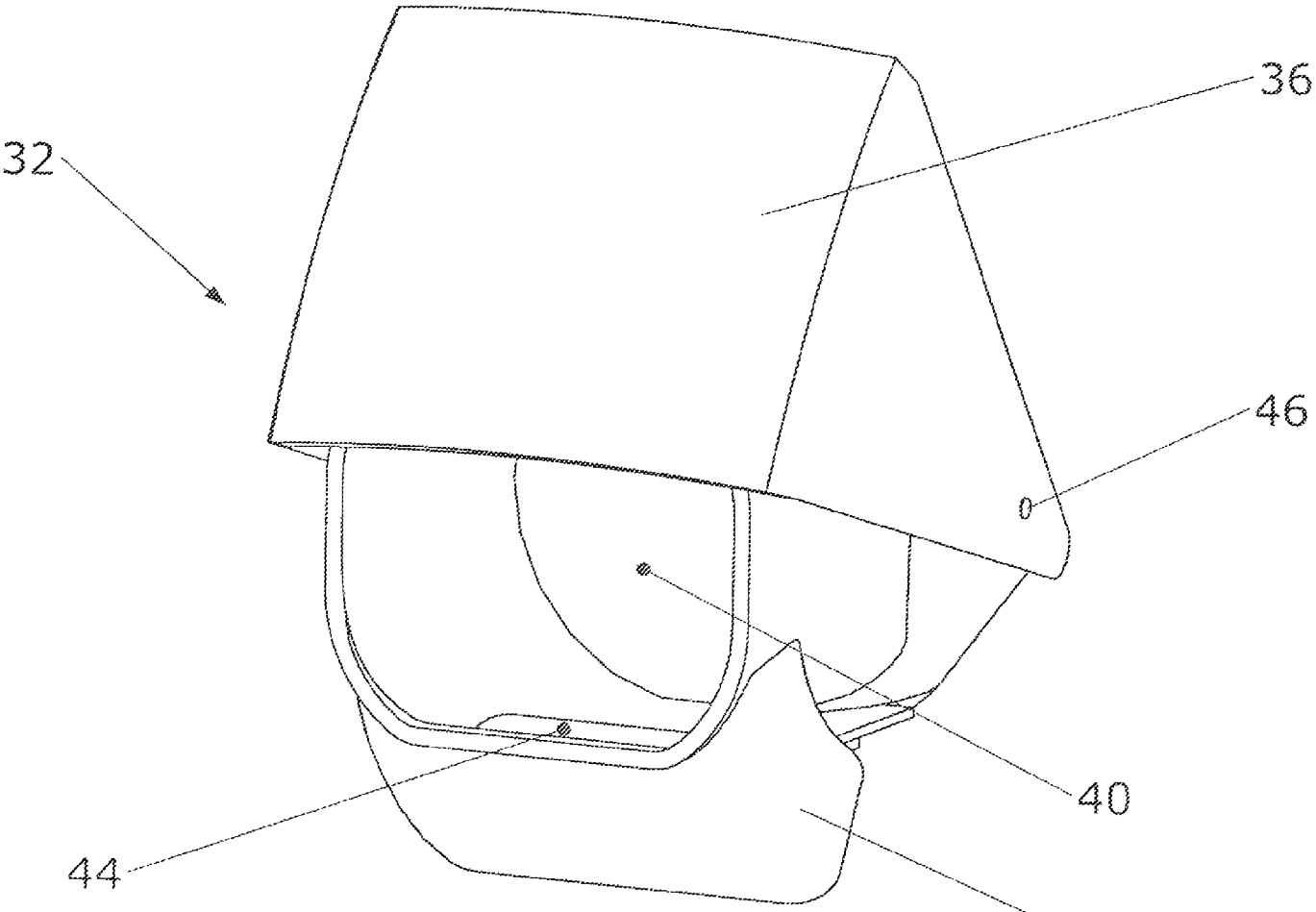
FIG. 2 (PRIOR ART)
FIG. 2 is a perspective view, showing a prior art steerable nozzle.

A prior art steerable nozzle 32 for watercraft vessels using water-jet propulsion systems is shown in FIGS. 1 and 2. Although steerable nozzle 32 is shown in detail in FIG. 2, the reader will appreciate that steerable nozzle 32 can be any type of prior art steerable nozzle 32 which attaches to a water-jet propelled watercraft. Steerable nozzle 32 is illustrated detached from a watercraft having a reverse gate 36. Reverse gate 36 attaches to nozzle 32 at a pivot point 46 on both sides of nozzle 32. When the watercraft is in reverse the reverse gate 36 covers exit point 40 and directs the jet stream downward through the thrust reversal channel 42 and out exit point 44.

Figure 3:
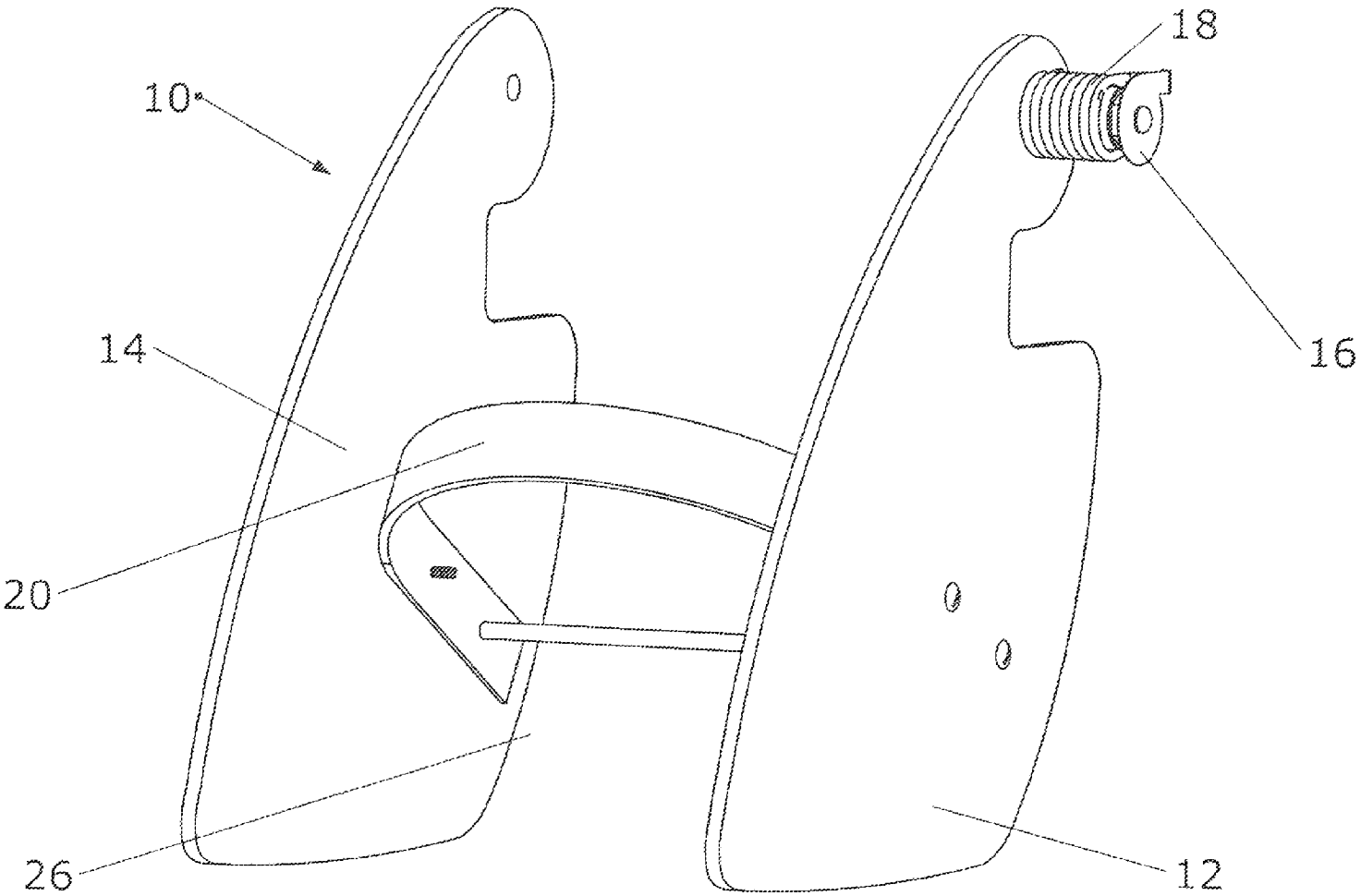
FIG. 3 is a perspective view, showing the present invention.

An auxiliary appendage 10 is shown in FIG. 3. Auxiliary appendage 10 is a device which improves the steering and directional control of any water jet powered craft by attachment to an existing steerable nozzle 32 (illustrated in FIG. 2). Auxiliary appendage 10 is generally comprised of first rudder blade 12, second rudder blade 14, adjustable torsion spring 18 and deflection bar 20. First and second rudder blades 12, 14 are connected together by deflection bar 20. First rudder blade 12 includes a torsion spring 18 and a spring tensioner 16. Spring tensioner 16 is used to adjust and maintain the downward force created by the torsion spring on the rudder blades 12, 14. An optional stabilization bar 26 maintains the set distance between the rudder blades 12, 14 and provides structural integrity without interfering with the movement of the rudder blades 12, 14.

Figure 4:
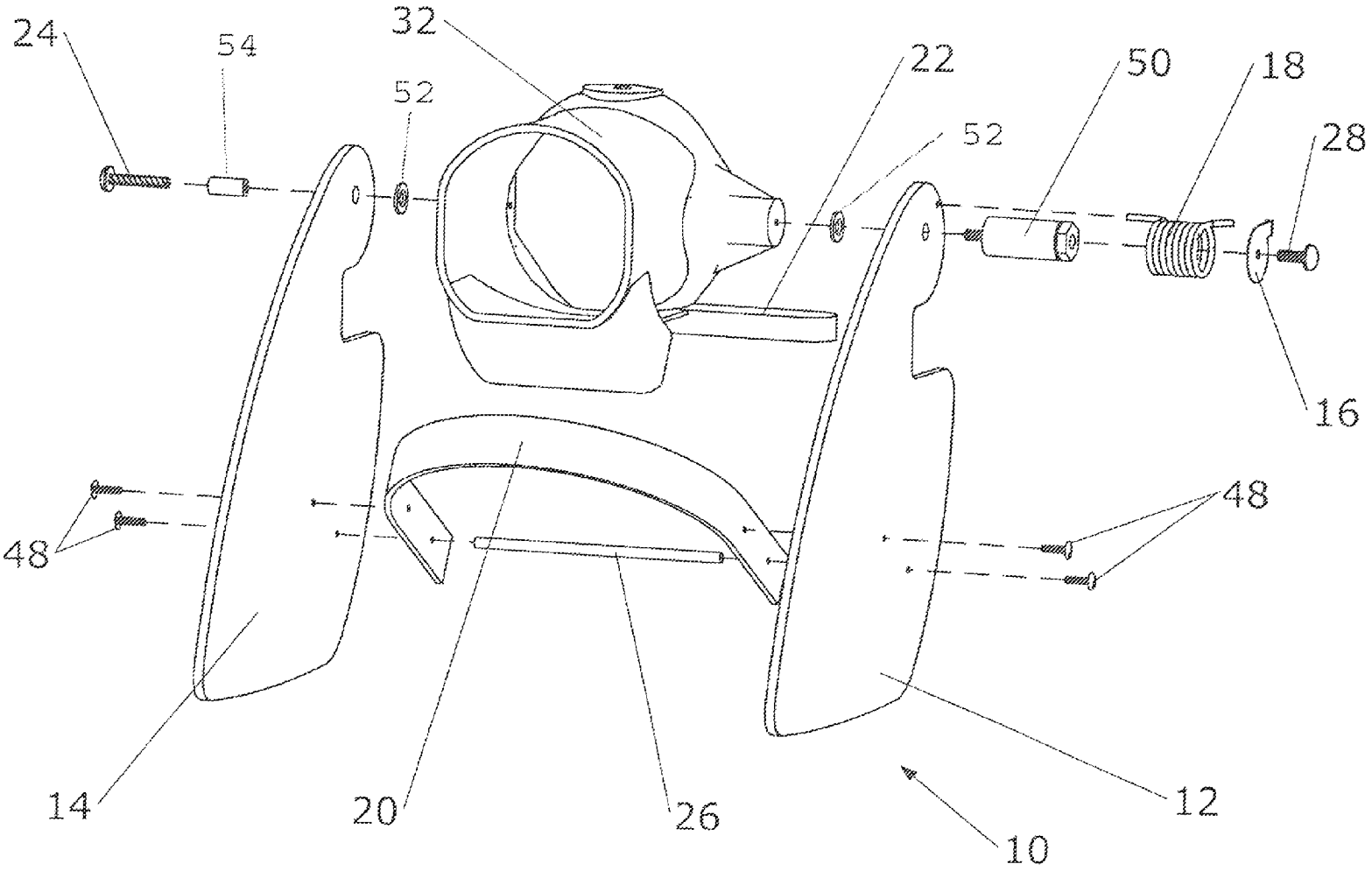
FIG. 4 is an expanded view, showing the present invention prepared to be attached to a prior art steerable nozzle.

FIG. 4 is an expanded view showing the attachment of the auxiliary appendage 10 to an existing steerable nozzle 32. For clarity, the reverse gate has been removed from the figure—however, if the nozzle included a reverse gate, reverse gate would attach directly to the steerable nozzle 32, fitting between steerable nozzle 32 and rudder blades 12, 14. The reader will appreciate that any known method of connecting auxiliary appendage 10 to a prior art steerable nozzle 32 can be used. For example, where existing steerable nozzle 32 does not include bolt holes, auxiliary appendage 10 may be coupled to a bracket which attaches to or fits around steerable nozzle 32. In the alternative, the auxiliary appendage 10 can be fully integrated with the existing water craft 30. Thus, the appendage 10 should not be limited to the present embodiment.

In the present view, the broken lines represent the alignment of the prior art steerable nozzle 32 with the auxiliary appendage 10. Steerable nozzle 32 includes a detent 22 and two bolt holes, which act as the pivot point (typically for attachment of reverse gate shown in FIG. 2). First rudder blade 12 fits Into position beside steerable nozzle 32 such that detent 22 extends through first rudder blade 12. Washers 52 can be placed between steerable nozzle 32 and first and second rudder blades 12, 14 (or reverse gate and rudder blades). A threaded bolt 50 attaches first rudder blade 12 to steerable nozzle 32. Threaded bolt 50 includes a central threaded void. Torsion spring 18 fits around threaded bolt 50 and hooks into first rudder blade 12. Spring tensioner 16 hooks onto torsion spring 18 while bolt 28 holds spring tensioner 16 in a set position. Bolt 28 is placed through spring tensioner 16 into the central threaded void of threaded bolt 50. As bolt 28 is tightened, spring tensioner 16 is set at the desired tension, which controls the downward force that tension spring 18 exacts on first and second rudder blades 12, 14. Second rudder blade 14 is attached to steerable nozzle 32 parallel to first rudder blade 12. Bolt 24 fits through second rudder blade 14, through washer 52 into steerable nozzle 32. Additionally, a standoff 54 can be used to act as a pivot point for second rudder blade 14. Deflection bar is attached to first and second rudder blades 12, 14 by bolts 48. Likewise, an optional stabilization bar 26, attaches to both first and second rudder blades 12, 14 at bolts 48, as shown. Washers should be used in conjunction with bolts 28 to distribute the load on the bolts and act as spacers.

Figure 5:
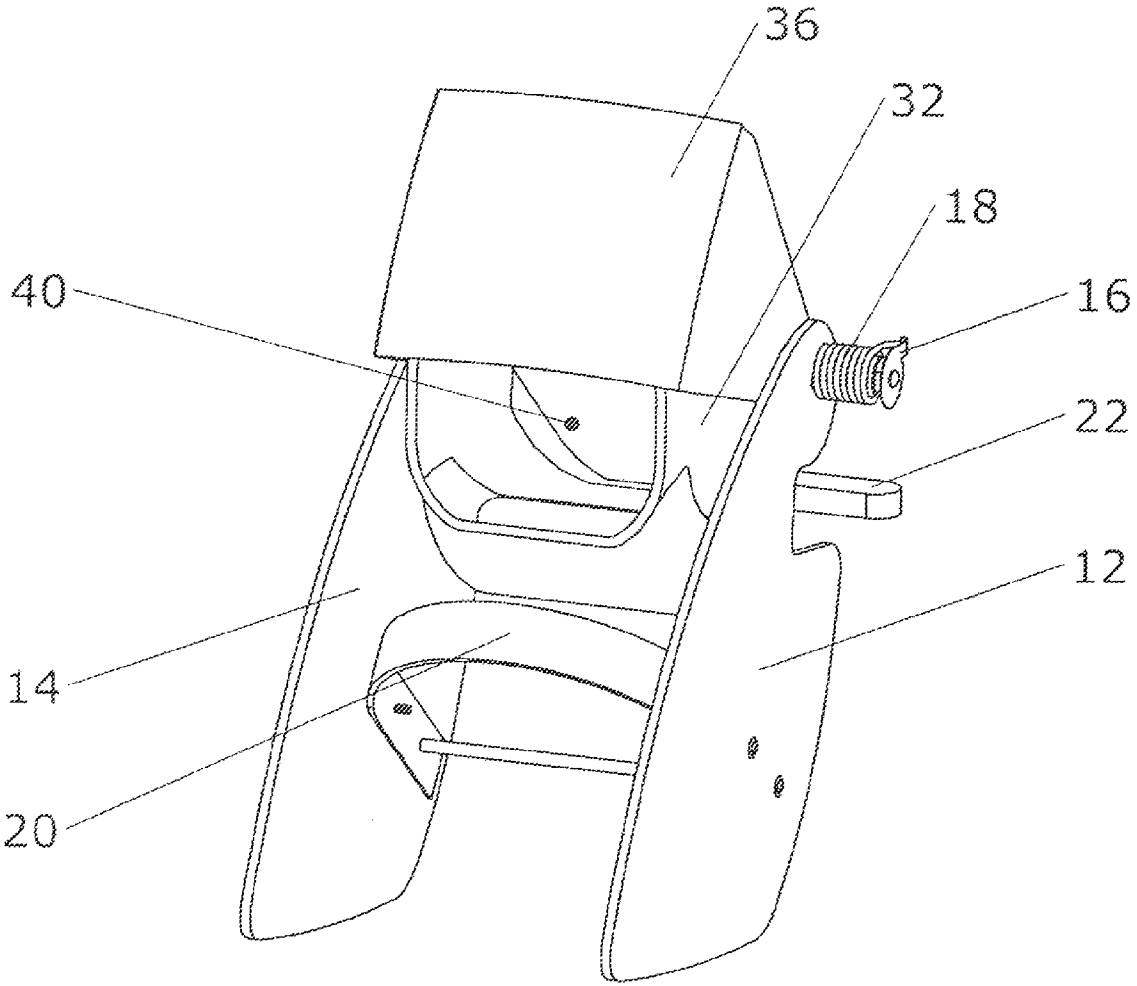
FIG. 5 is a perspective view, showing the present invention attached to a prior art steerable nozzle.

Of note, auxiliary appendage 10 can be attached in the same manner with a prior art reverse gate 36 and thrust reversal channel included on the steerable nozzle 32, as shown in FIG. 5. Auxiliary appendage is shown in a downward position. In such an embodiment, first and second rudder blades 12, 14 would be positioned on either side of reverse gate 36. Torsion spring 18 maintains a downward torsion force on rudder blades 12, 14. The torsion spring 18 is adjustable by repositioning spring tensioner 16. Thus, the downward torsion force can be adjusted to increase or decrease the downward force with relation to the pivot point of reverse gate 36 for precise adjustment for a multitude of water-jet driven vessels. Detent lever 22 on steerable nozzle 32 prevents rudder blades 12, 14 from hyper-extending in the same direction of the downward torsion force. Deflection bar 20 connected to the lower end of first and second rudder blades 12, 14 is slightly angled towards rudder blades 12, 14, as illustrated.

In operation, auxiliary appendage 10 provides supplemental rudders while the water craft is moving at a low velocity while automatically repositioning the rudders 12, 14 at high velocities. This action is further illustrated in FIGS. 6, 7 and 8.

Figure 6:
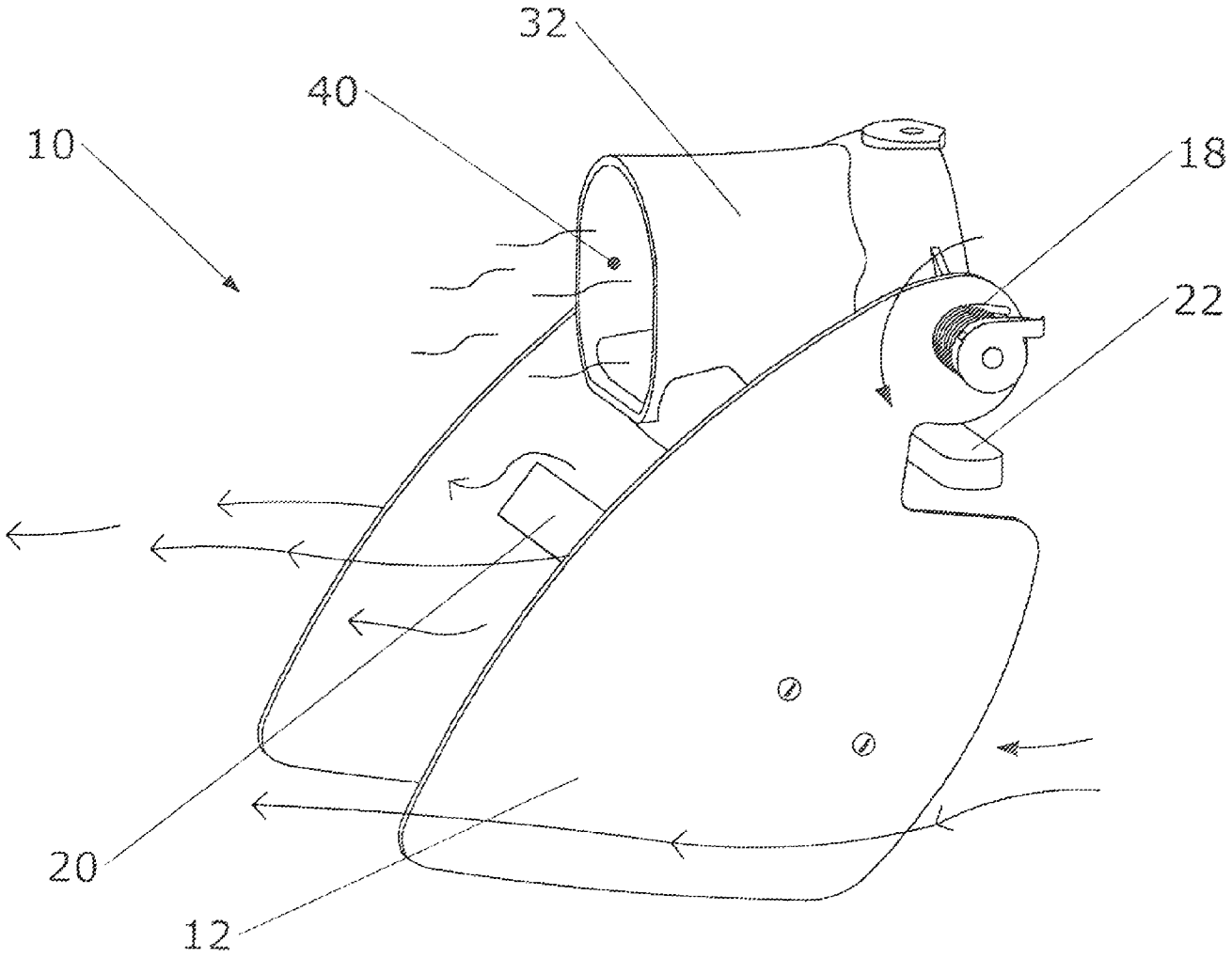
FIG. 6 is a perspective view, showing the present invention moving through a body of water at a low speed.

In FIG. 6 auxiliary appendage 10 is attached to a prior art steerable nozzle 32. As the water jet powered craft moves through the water at low velocities the first and second rudder blades 12, 14 move smoothly through the water, allowing the rudder blades 12, 14 to effectively control the watercraft. The force downward on torsion spring 18 (shown as a curved arrow) is greater than the upward force of the water on deflection bar 20 (movement of water is shown as a series of arrows). Therefore, the first and second rudder blades 12, 14 remain in a downward position when the water craft maintains a slow speed. At slow moving speeds the water's laminar flow about the first and second rudder blades 12, 14 allows for increased directional control of the water craft.

Figure 7:
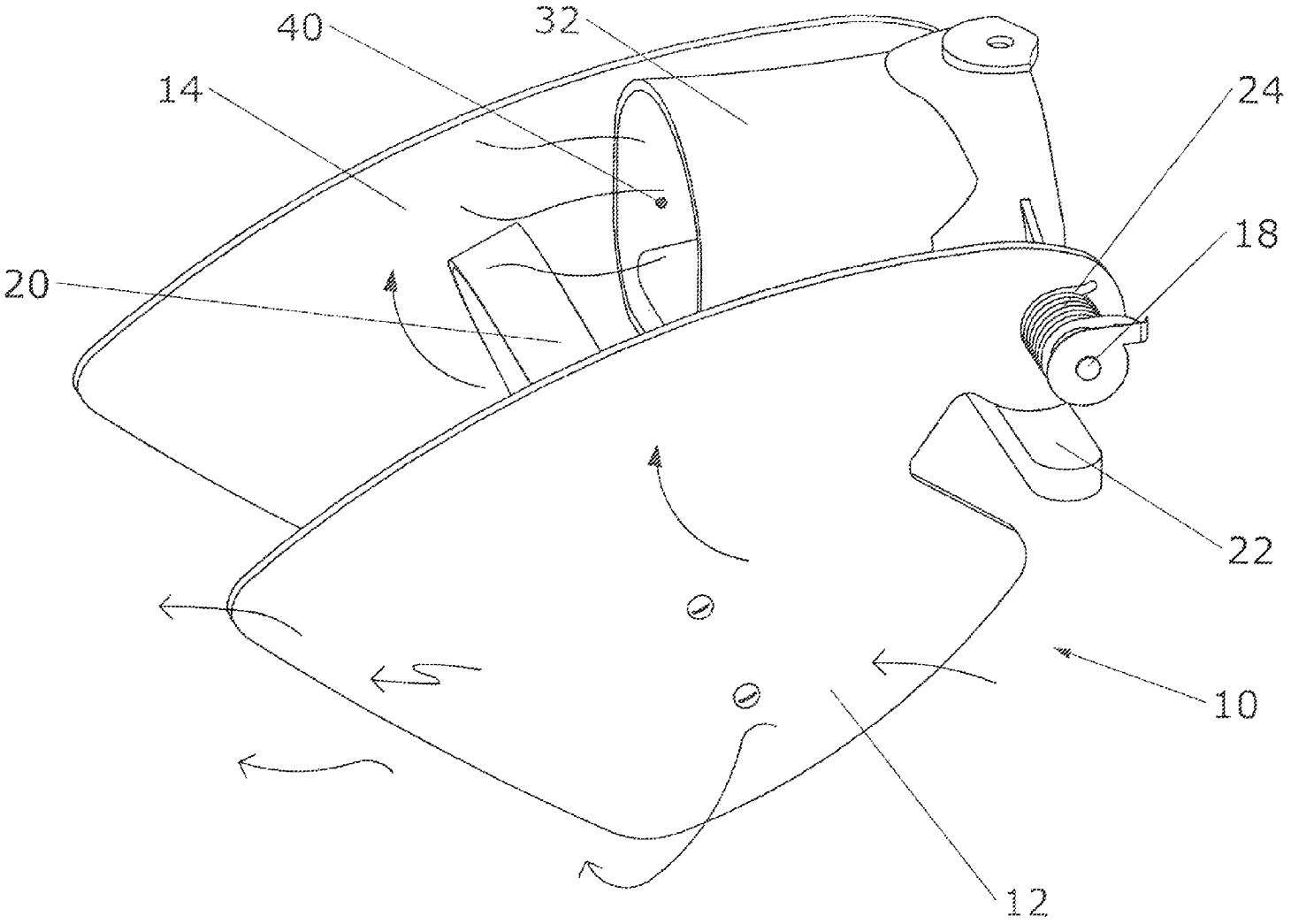
FIG. 7 is a perspective view, showing the present invention moving through a body of water at a moderate speed.
Figure 8:
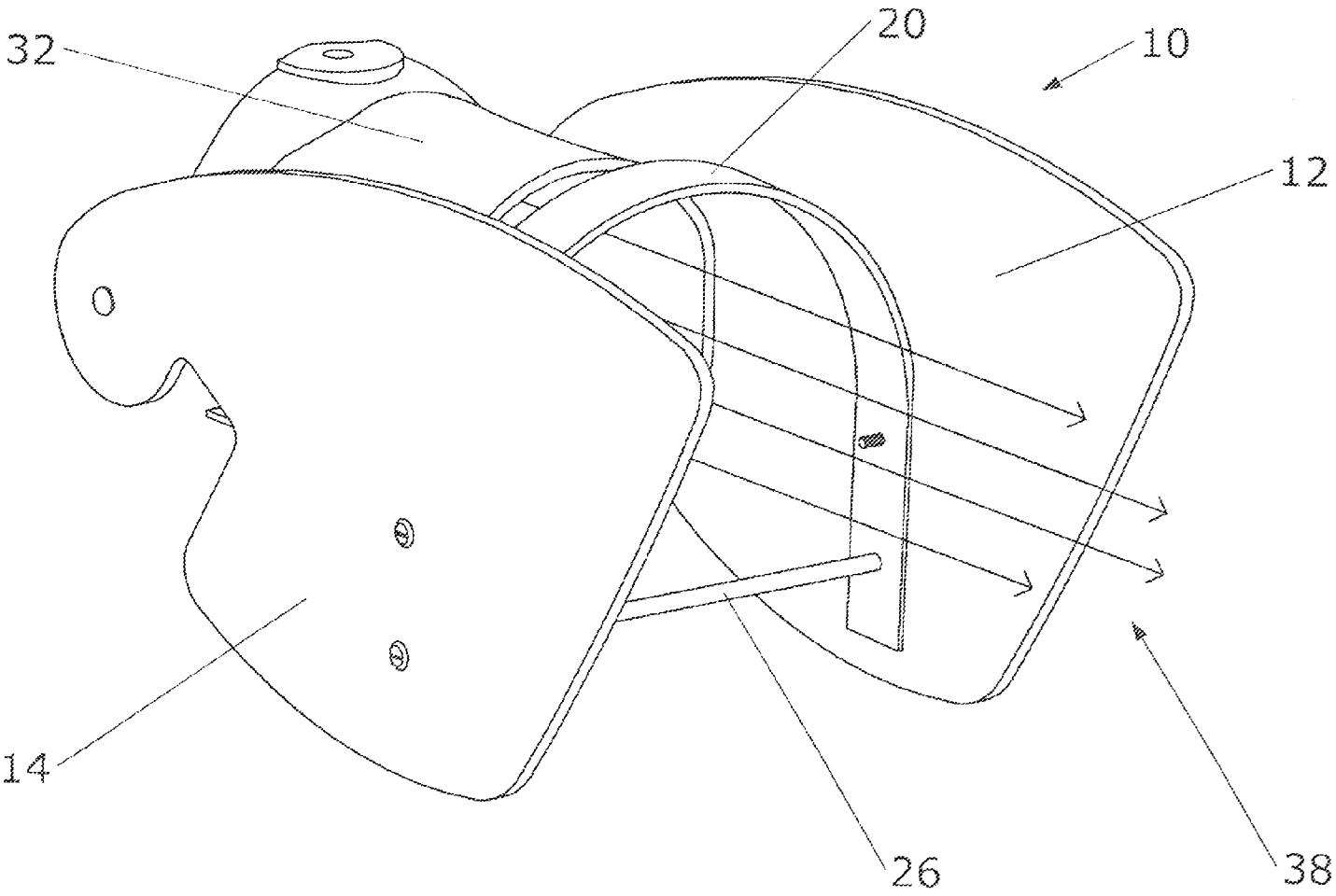
FIG. 8 is a perspective view, showing the present invention moving through a body of water at a high velocity.

As the water craft begins to increase in speed, the jet stream 38 becomes more forceful, as illustrated in FIG. 7. As the water moves over the auxiliary appendage 10 at increased speeds, the turbulent water flow increases causing an increased upward force on deflection bar 20. This upward force begins to exceed the downward force created by torsion spring 18. As the deflection bar 20 is forced upward, the first and second rudder blades 12, 14 pivot upward.

At high velocities, turbulent flow increases and laminar flow decreases around the rudder blades 12, 14. Thus, as the watercraft increases in speed the rudder blades become ineffective and unpredictable. Additionally, if the rudder blades remain submerged within the water, the blades, nozzles and linkages experience greatly increased stress loads and sheer loads. It is therefore desirable that at high speeds first and second rudder blades 12, 14 lift out of the water such that the rudders no longer affect the steering of the water craft as shown, in FIG. 8. Thus, in FIG. 8, auxiliary appendage 10 is shown in an upward position.

Deflection bar 20 moves upward slowly at first as me upward force from the water flow on deflection bar matches and begins to exceed the downward force created by torsion spring 18 on the rudder blades 12, 14. When deflection bar 20 enters jet stream 38, deflection bar 20 is angled such that the upward force of the jet stream 38 will cause deflection bar 20 to quickly move upward through jet stream 38. Deflection bar 20 clears steerable nozzle 32 (and reverse gate 36, if relevant) simultaneously pulling rudder blades 12, 14 out of the water. As illustrated, optional stabilization bar 26 does not enter jet stream 38, remaining underneath jet stream 38.

At high speeds the water craft planes and the steering is well controlled by the expulsion of water from the water jet through steerable nozzle 32. If the user turns the craft the steerable nozzle 32 turns and the propulsion of water effectively controls the forward direction of the craft. As the watercraft slows down, the control over the steering of the craft via the steerable nozzle 32 decreases. The downward rotational force created by torsion spring 18 becomes greater than the upward force on deflection bar 20 as the speed of the craft decreases. This causes the rudder blades 12, 14 to submerge in the water once again and provide effective control over the watercraft at low speed. This can be extremely beneficial if the user must cut off power to the engine and quickly steer the water craft in a particular direction.

The preceding description contains significant detail regarding the novel aspects of the present invention. It is should not be construed, however, as limiting the scope of the invention but rather as providing illustrations of the preferred embodiments of the invention. As an example, any known manner of attaching the directional nozzle to the watercraft can be utilized. Thus, the scope of the invention should be fixed by the following claims, rather than by the examples given.

We claim:

1. An auxiliary appendage for attachment to a steerable nuzzle for accepting a jet stream said attachment comprising:

a. a first rudder blade coupled to said steerable nozzle;

b. second rudder blade coupled to said steerable nozzle;

c. wherein said first rudder blade is parallel to said second rudder blade;

d. a deflection bar coupled to said first rudder blade and said second rudder blade;

e. a torsion spring attached to at least one rudder blade, wherein said torsion spring is capable of providing downward torsion force on said first rudder blade and said second rudder blade;

f. wherein said deflection bar is capable of providing an upward force on said first rudder blade and said second rudder blade opposite said downward torsion force;

g. wherein said auxiliary appendage pivots between a downward position and an upward position;

h. a threaded bolt having a central threaded void for attachment or said first rudder blade to said steerable nozzle;

i. wherein said torsion spring around said threaded bolt and hooks into said first rudder blade; and j. wherein a spring tensioner is connected to said torsion spring and held in place by a second bolt.

2. The attachment of claim 1, wherein said second rudder blade is connected to said steerable nozzle by a third bolt.

3. An auxiliary attachment for attachment to a steerable nozzle for accepting a jet stream said attachment comprising:

a. a first rudder blade coupled to said steerable nozzle;

b. a second rudder blade coupled to said steerable nozzle;

c. a deflection bar positioned between said first rudder blade and said second rudder blade;

d. wherein said first rudder blade and said second rudder blade are held in a downward position by a downward torsion force;

e. wherein said deflection bar is capable of providing an upward force on said first rudder blade and said second rudder blade opposite said downward torsion force;

f. torsion spring, which is capable of providing variable degrees of said downward torsion force in conjunction with a spring tensioner;

g. a threaded bolt having a central threaded void for attachment of said first rudder blade to said steerable nozzle;

h. wherein said torsion spring fits around said threaded bolt and hooks into said first rudder blade; and i. wherein a spring tensioner is connected to said torsion spring and held in place by a second bolt.

* * * * *